US011166530B1

(12) United States Patent
Wilson, Jr.

(10) Patent No.: US 11,166,530 B1
(45) Date of Patent: Nov. 9, 2021

(54) CONVERSION KIT FOR USING TREKKING POLES AS CAMPING CHAIR

(71) Applicant: Tommy Maurice Wilson, Jr., Cuyahoga Falls, OH (US)

(72) Inventor: Tommy Maurice Wilson, Jr., Cuyahoga Falls, OH (US)

( * ) Notice: Subject to any disclaimer, the term of this patent is extended or adjusted under 35 U.S.C. 154(b) by 0 days.

(21) Appl. No.: 17/069,309

(22) Filed: Oct. 13, 2020

(51) Int. Cl.
*A45B 5/00* (2006.01)
*A45B 9/02* (2006.01)
*A63B 29/08* (2006.01)

(52) U.S. Cl.
CPC ..... *A45B 5/00* (2013.01); *A45B 9/02* (2013.01); *A63B 29/08* (2013.01)

(58) Field of Classification Search
CPC ..... A45B 5/00; A45B 9/02; A63B 29/08
See application file for complete search history.

(56) References Cited

U.S. PATENT DOCUMENTS 2,257,831 A * 10/1941 Wood ..... A63C 11/001 280/812
2,445,344 A * 7/1948 Wachtel ..... A63C 11/00 280/812
2,742,956 A * 4/1956 Cannata ..... A47C 15/004 297/129
4,065,140 A * 12/1977 Cadwalader ..... A45B 5/00 280/812
4,786,082 A * 11/1988 Swietlik ..... A45B 5/00 135/66
9,326,612 B2 * 5/2016 Kim ..... A47C 9/10
9,622,554 B2 * 4/2017 Green ..... A63C 11/00
9,854,882 B1 * 1/2018 Peck ..... A45B 3/00
10,285,503 B2 * 5/2019 Graybill ..... A47C 4/286
2021/0052076 A1 * 2/2021 Graybill ..... A47C 4/03

* cited by examiner

*Primary Examiner* — Noah Chandler Hawk
(74) *Attorney, Agent, or Firm* — Kathleen K Bowen

(57) ABSTRACT

A conversion kit for converting a pair of standard trekking poles into a camp chair consists of two corner brackets, two cross brackets, two compression brackets, and a fabric sling for a seat. Standard trekking poles have 3 segments that combine together, a handle segment, a middle segment and a tip segment. The corner brackets connect the two tip segments, and one of the middle segments. The cross brackets connect the two handle segments to the two tip segments. The compression bracket connects the two handle segments to the other middle segment. The fabric sling is attached to the two middle segments, and the two tip segments.

17 Claims, 8 Drawing Sheets

CONVERSION KIT FOR USING TREKKING POLES AS CAMPING CHAIR

BACKGROUND

The present invention is in the field of hiking and camping. More specifically this invention relates to using a standard trekking pole set as a camp chair by means of a conversion kit.

DETAILED DESCRIPTION

Figure 1:
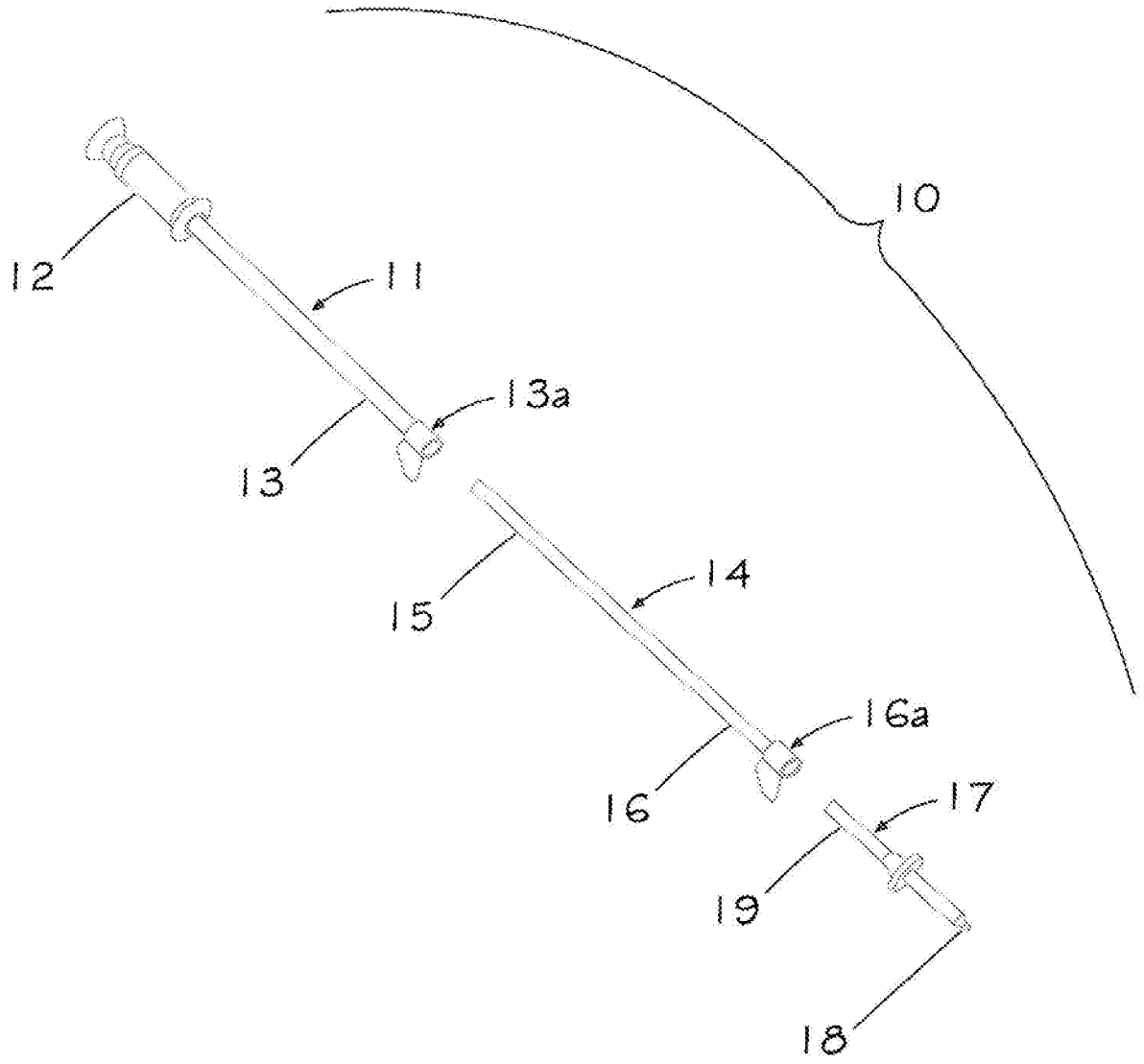
FIG. 1 is an isometric view of a standard three-piece trekking pole.
Figure 2:
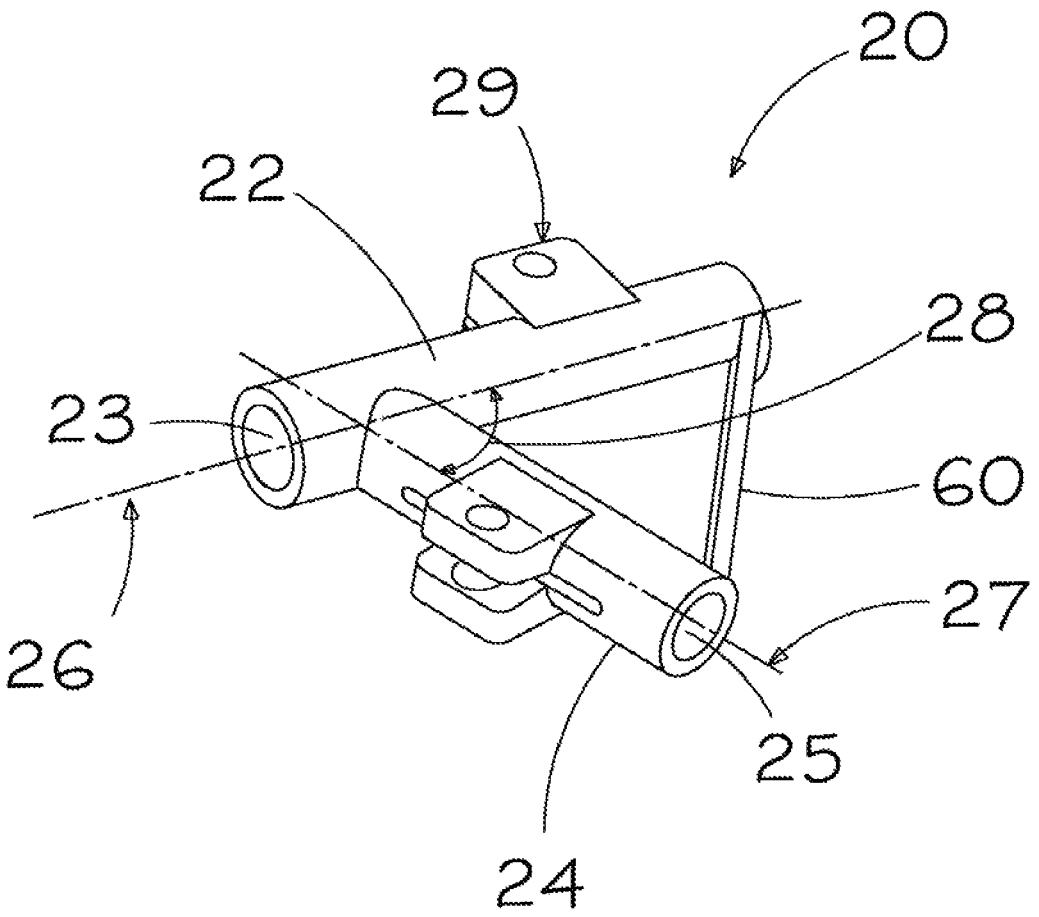
FIG. 2 is an isometric view of a corner bracket for a conversion kit for using trekking poles as a camp chair according to an aspect of the invention.
Figure 2A:
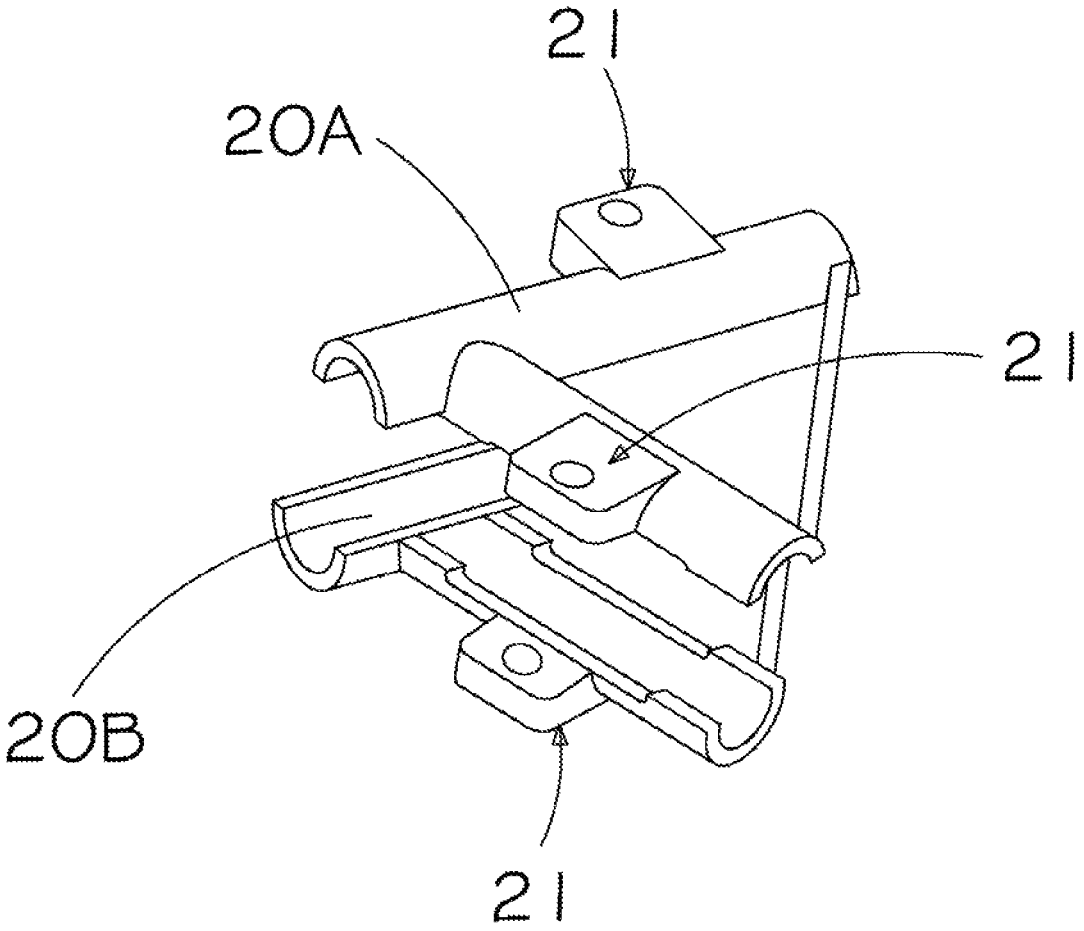
FIG. 2A is an exploded view of a corner bracket for a conversion kit for using trekking poles as a camp chair according to an aspect of the invention.
Figure 3:
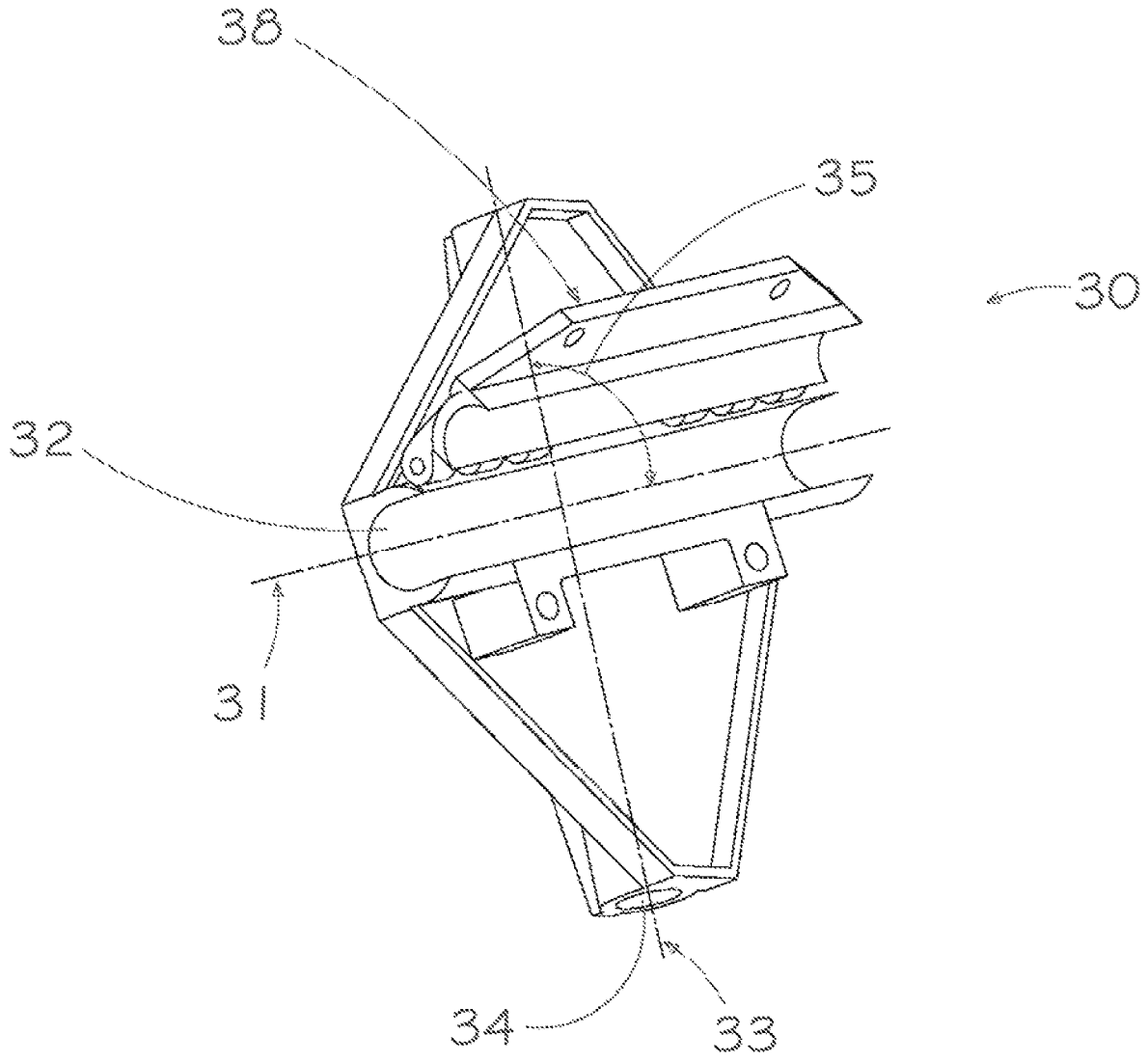
FIG. 3 is an isometric view of a cross bracket for a conversion kit for using trekking poles as a camp chair according to an aspect of the invention.
Figure 3A:
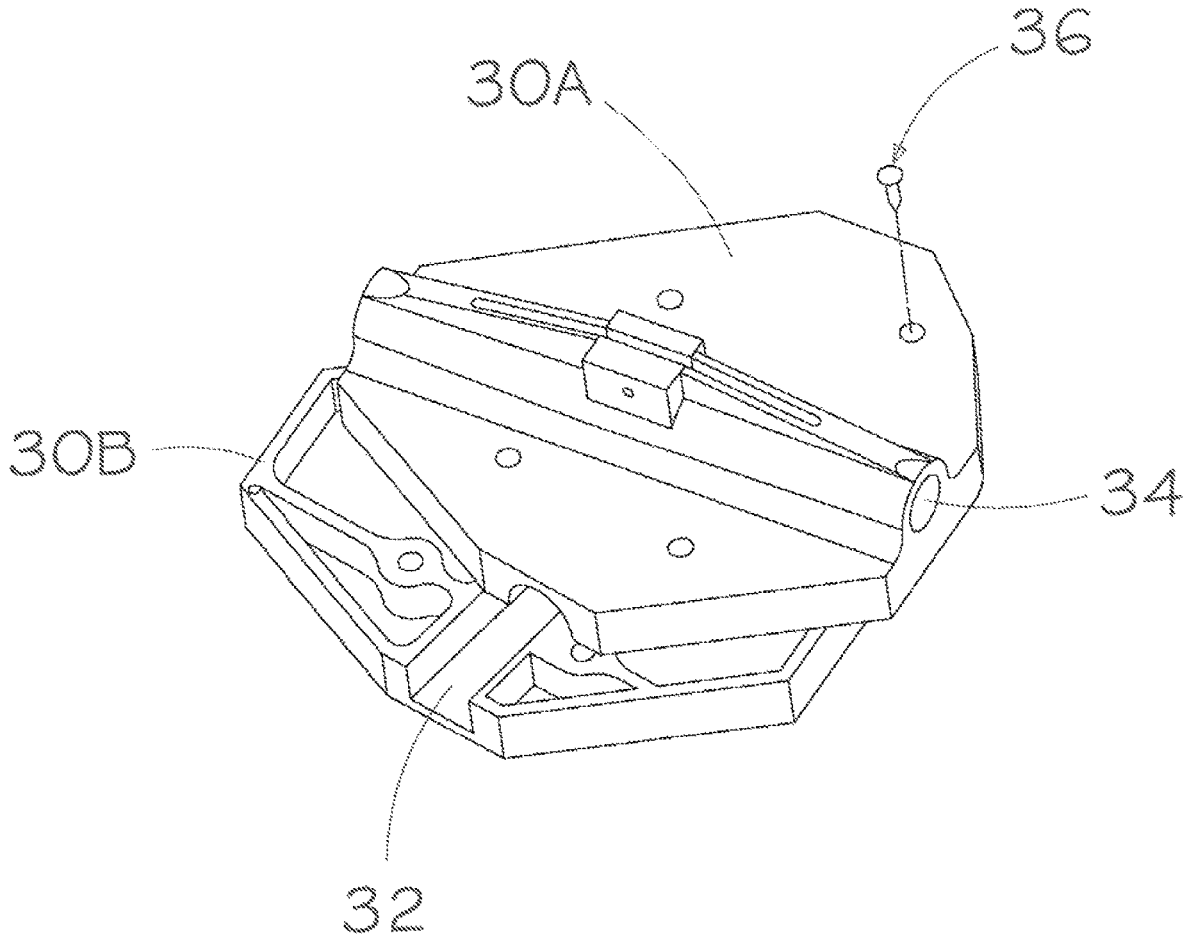
FIG. 3A is an exploded isometric view of a cross bracket for a conversion kit for using trekking poles as a camp chair according to an aspect of the invention.
Figure 4:
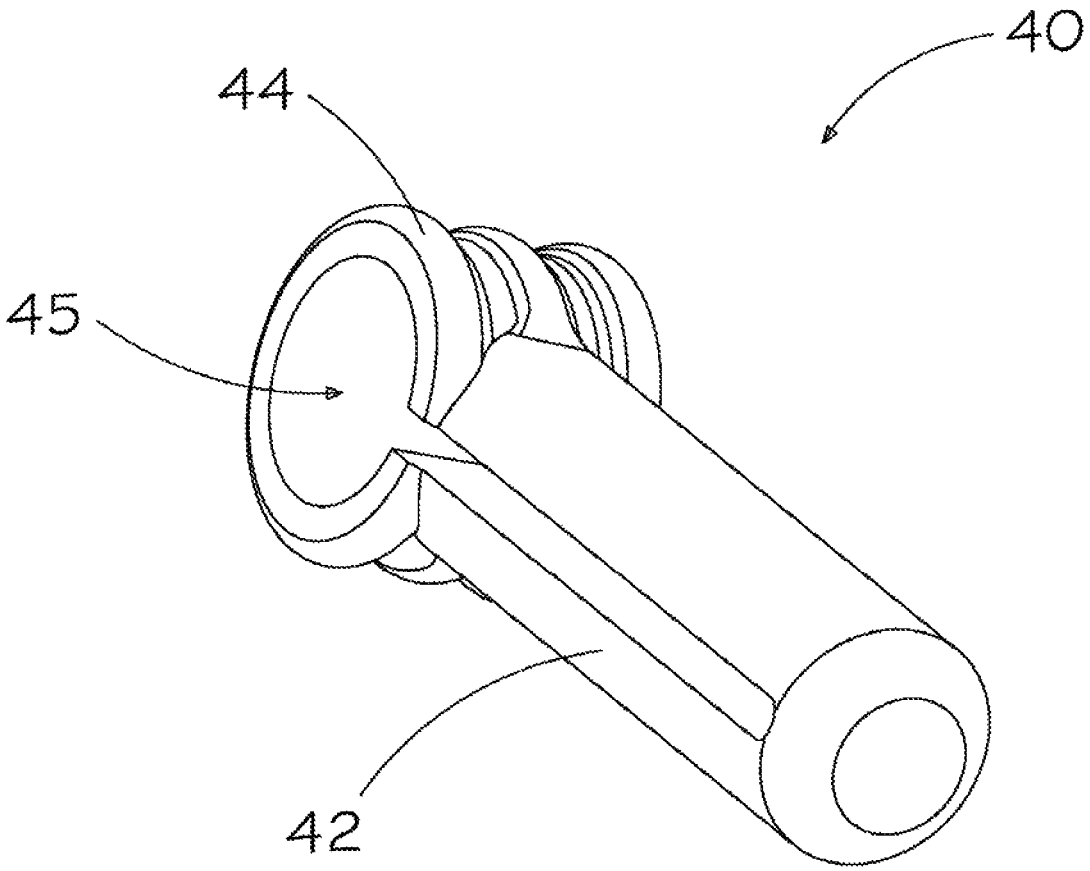
FIG. 4 is an isometric view of a compression bracket for a conversion kit for using trekking poles as a camp chair according to an aspect of the invention.
Figure 5:
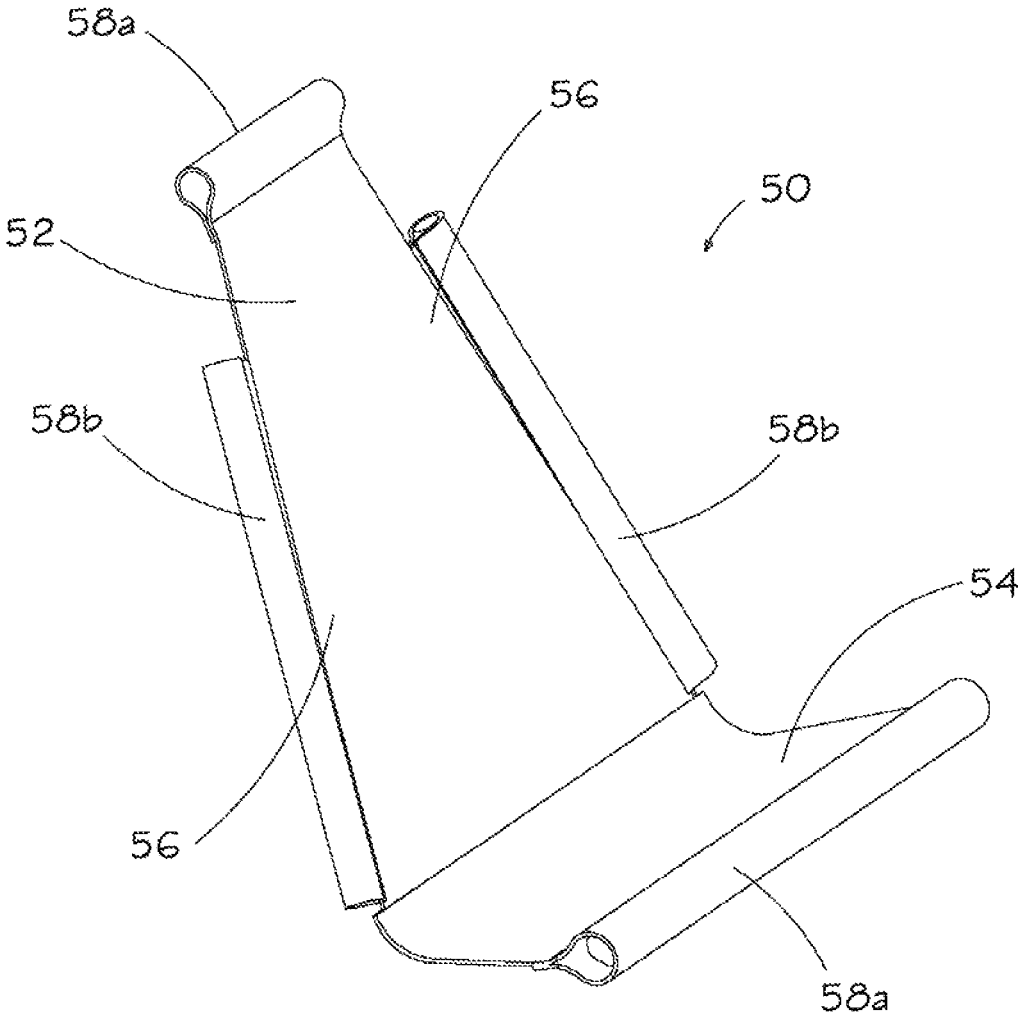
FIG. 5 is an isometric view of a fabric sling for a conversion kit for using trekking poles as a camp chair according to an aspect of the invention.
Figure 6:
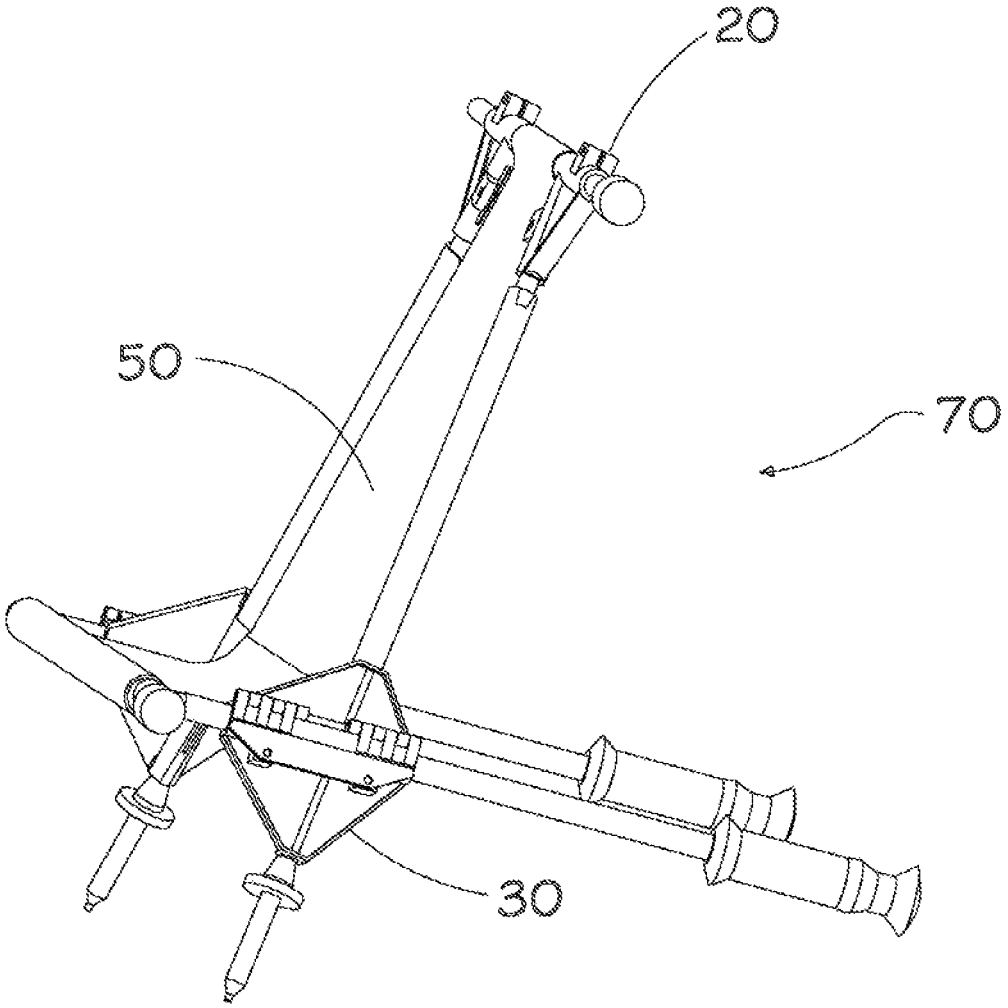
FIG. 6 is an isometric view of an assembled camp chair using a conversion kit for using trekking poles as a camp chair according to an aspect of the invention.

Various aspects of the invention are presented in FIGS. 1-6 which are not drawn to scale. Referring now to these figures, according to an aspect of the invention, a kit for converting a standard set of two trekking poles into a camp chair is shown.

A standard trekking pole 10 is comprised of three interlocking segments, namely a handle segment 11, a middle segment 14, and a tip segment 17. The handle segment 11 has a handle end 12 and an opposing end A 13. The middle segment 14 has an end B 15 and an opposing end C 16, wherein end B 15 connects to the handle segment end A 13. The handle segment 11 further has a compression mechanism 13*a* on end 13 such that when the middle segment end 15 is inserted into the handle segment end 13 the compression mechanism 13*a* is then engaged to secure the connection of the two segments. The tip segment 17 has a tip end 18 and an opposing end D 19, which connects to middle segment end C 16. The middle segment 14 further has a compression mechanism 16*a* on end 16 such that when the tip segment end 19 is inserted into the middle segment end 16 the compression mechanism 16*a* is then engaged to secure the connection of the two segments.

The conversion kit comprises two corner brackets 20, two cross brackets 30, two compression brackets 40, and a fabric sling 50.

The corner brackets 20 each have a horizontal portion 22 and a vertical portion 24. The horizontal portion 22 has a through hole E 23 sized to receive the trekking pole middle segment 14. The vertical portion 24 has a hole F 25 sized to receive the tip segment end D 19.

The cross brackets 30 each have a first through hole 32 and a second through hole 34. The first through hole 32 is sized to receive the handle segment 11, and the second through hole 34 is sized to receive the tip segment 17. The first through hole 32 is approximately perpendicular to the second through hole 34, but the first through hole 32 does not intersect the second through hole 34. Due to the handle on one end, and the compression mechanism 13*a* on the other end of the handle segment, through hole 32 must be able to be opened to insert the handle segment 11. Therefore, according to an aspect of the invention. the cross brackets 30 may be comprised of two halves, a first half 30A, and a second half 30B, such that the halves fit together in a clamshell fashion, wherein the second half 30B has the second through hole, 34 and the first through hole 32 is formed by the combination of the two halves, such that the handle segment can be placed in the first half, and the second half can then be attached, sandwiching the handle segment between them. According to this aspect of the invention, there is an attachment mechanism 36 for attaching these halves together.

In a preferred embodiment, the cross bracket 30 has a hinged piece 38 which hinges to open up through hole 32 so the handle portion 11 may be placed within, and then hinges closed. This hinged portion 38 may then be further secured with an attachment mechanism, such as a screw.

The compression brackets 40 each have a male end 42 and a female end 44 which is perpendicular to the male end 42. The male end 42 is sized to fit within the handle segment end A 13, and the female end 44 comprises a through hole 45 which is sized to receive the middle segment 14.

The fabric sling 50 has four sides, a top side 52, a bottom side 54, and opposing vertical sides 56. The top side 52 and bottom side 54 each have an attachment mechanism 58*a* for attachment to the middle segment 14 of the trekking poles 10.

The corner bracket through hole E 23 has a centerline 26, and the corner bracket hole F has a centerline 27. These centerlines create an angle 28, according to an aspect of the invention, angle 28 is between 65 and 85 degrees. In a preferred embodiment, angle 28 is approximately 75 degrees.

The corner bracket holes need to have enough length to provide adequate support to the inserted trekking pole segments when the chair is in use. According to an aspect of the invention, corner bracket through hole E 23 has a length of at least 3.5 inches, and corner bracket hole F 25 has a length of at least 2.5 inches.

In order to ensure the chair stays together, the corner bracket through hole E 23 and hole F 25 may be sized for a compression fit with the trekking pole middle segment 14 and the tip segment end D 19 respectively. According to a further aspect of the invention, the corner brackets further comprise a clamping mechanism 29, to clamp the bracket 20 more tightly around the trekking pole segments, once they are in place. In a further embodiment, the corner bracket 20 is comprised of two halves, 20A, and 20B, such that the halves fit together in a clamshell fashion, forming the through hole E 23 and hole F 25, such that the appropriate trekking pole segments can be placed in one half, and the second half can then be attached, sandwiching the trekking pole segments between them, wherein there is an attachment mechanism 21 for attaching the halves together.

According to an aspect of the invention, the corner brackets 20 further comprise a support member 60, having opposing ends, wherein one end is attached to the horizontal portion 22, and the opposing end is attached to the vertical portion 24.

The cross bracket first through hole 32 has a centerline 31, and second through hole 34 has a centerline 33. These centerlines create an angle 35. According to an aspect of the invention, the angle 35 is between 70 degrees and 85 degrees. In a preferred embodiment, the angle 35 is approximately 80 degrees.

The cross bracket through holes need to have enough length to provide adequate support to the inserted trekking pole segments when the chair is in use. Therefore, according to an aspect of the invention, the cross bracket through holes 32 and 34 have a length of at least 2 inches each. In a preferred embodiment, the cross bracket through holes 32 and 34 have a length of at least 4 inches each.

In order to further stabilize the chair, according to an aspect of the invention, the fabric sling vertical sides 56 also each have attachment mechanisms 58*b* for attaching to the trekking pole tip segment 17.

The attachment mechanisms 58*a* and 58*b* used for the fabric sling 50 may be fabric sleeves sewn into the ends, such that the appropriate segment of the trekking pole can slide through. The attachment mechanisms 58*a* and 58*b* may also be Velcro loops, ties, snap loops, or any similar method by which the fabric sling could be attached.

The conversion kit is assembled into a chair 70. In order to assemble, the trekking poles 10 are taken apart. The handle segment 11 and tip segment 17 are placed in the cross bracket, such that the cross bracket is closer to the handle segment end A 13 than the handle end 12 and closer to the tip segment tip end 18 than the tip segment end D 19. If the Fabric sling vertical sides 56 have an attachment mechanism 58*b*, then this attachment mechanism 58*b* should be attached to the tip segment 17. Each tip segment end D 19 should be inserted into a corner bracket vertical portion hole F 25. Then a middle segment 14 should be inserted all the way through the through hole E 23 of one corner bracket 20, and as this middle segment 14 exits the through hole E 23, it should then be inserted through the fabric sling top side 52 attachment mechanism 58*a*, then into hole E 23 of the other corner bracket 20. The corner brackets should be placed such that the angle 28 and the fabric sling are on opposite sides of the tip segment. Then the remaining middle segment 14 should be inserted all the way through the through hole 45 of a compression bracket 40, and as this middle segment 14 exits the through hole 45, it should then be inserted through the fabric sling bottom side 54 attachment mechanism 58*a*, then through the through hole 45 of the other compression bracket 40. Then each compression bracket male end 42 should be inserted into a handle segment end A 13. The compression mechanism 13*a* should then be engaged. These steps could be done in any order that would accomplish the same construction. Any attachment mechanisms of the corner brackets 20 and the cross brackets 30 should then be secured.

The compression brackets male end 42, and female end through hole 45 each need to have enough length to provide adequate support to the inserted trekking pole segments when the chair is in use. Thus, according to an aspect of the invention, the compression bracket male end and female end each have a length of at least 1 inch.

In order to further stabilize the chair, according to an aspect of the invention, when the compression bracket male end 42 is inserted into the handle segment end A 13, the compression mechanism 13*a* is activated to compress the handle segment end A 13 over the middle segment male end 42.

I claim:

1. A conversion kit for using standard trekking poles to make a camp chair, wherein the standard trekking poles are comprised of three interlocking segments, namely a handle segment, wherein the handle segment has a handle end and an opposing end A, a middle segment having an end B which connects to handle segment end A, and an opposing end C, the handle segment further has a compression mechanism on end A such that when the middle segment end B is inserted into the handle segment end A the compression mechanism is then engaged to secure the connection of the two segments, and a tip segment, wherein the tip segment has a tip end and an opposing end D, which connects to middle segment end C, the kit comprising:

Two corner brackets each having a horizontal portion and a vertical portion, wherein said horizontal portion has a through hole E sized to receive the trekking pole middle segment, and wherein said vertical portion has a hole F sized to receive the tip segment end D;

Two cross brackets each having a first through hole and a second through hole, wherein said first through hole is sized to receive the handle segment, and said second through hole is sized to receive the tip segment, wherein said first through hole is approximately perpendicular to said second through hole, and further wherein said first through hole does not intersect said second through hole, further, said first through hole must be able to be opened to allow placement of the handle portion, and then closed around the handle portion to secure said handle portion;

Two compression brackets each having a male end and a female end which is perpendicular to said male end, wherein said male end is sized to fit within the handle segment end A, and said female end comprises a through hole which is sized to receive the middle segment;

A fabric sling having four sides, a top side, a bottom side, and opposing vertical sides, wherein said top side and said bottom side each have attachment mechanisms for attachment to the middle segment of the trekking poles.

2. The conversion kit of claim 1, wherein said corner bracket through hole E has a centerline, and said hole F has a centerline, and wherein these centerlines are at an angle of between 65 and 85 degrees to each other.

3. The conversion kit of claim 2 wherein said centerlines are at an approximately 75 degree angle to each other.

4. The conversion kit of claim 1 wherein said corner bracket through hole E has a length of at least 3.5 inches, and said hole F has a length of at least 2.5 inches.

5. The conversion kit of claim 1 wherein said corner bracket through hole E and hole F are sized for a compression fit with the trekking pole middle segment and the tip segment end D respectively.

6. The conversion kit of claim 1 wherein the corner brackets further comprise a clamping mechanism, to clamp said bracket more tightly around the trekking pole segments, once they are in place.

7. The conversion kit of claim 1 wherein said corner brackets are comprised of two halves, such that the halves fit together in a clamshell fashion, forming the through hole E and hole F, such that the appropriate trekking pole segments can be placed in one half, and the second half can then be attached, sandwiching the trekking pole segments between them, wherein there is an attachment mechanism for attaching said halves together.

8. The conversion kit of claim 1 wherein said corner brackets further comprise a support member, having opposing ends, wherein one end is attached to said horizontal portion, and the opposing end is attached to said vertical portion.

9. The conversion kit of claim 1 wherein said cross bracket first through hole is at an angle between 70 degrees and 85 degrees relative to said second through hole.

10. The conversion kit of claim 1 wherein said cross bracket first through hole is at an angle of approximately 80 degrees relative to said second through hole.

11. The conversion kit of claim 1 wherein said cross brackets are comprised of two halves, a first half and a second half, such that the halves fit together in a clamshell fashion, wherein the second half has the second through hole, and the first through hole is formed by the combination of the two halves, such that the handle segment can be placed in the first half, and the second half can then be attached, sandwiching the handle segment between them, wherein there is an attachment mechanism for attaching said halves together.

12. The conversion kit of claim 1 wherein said cross bracket has a hinged piece which hinges to open up said first through hole so the handle portion may be placed within, and then hinged closed, wherein there is an attachment mechanism for securing the hinged portion closed.

13. The conversion kit of claim 12 wherein said fabric sling attachment mechanisms comprise fabric sleeves.

14. The conversion kit of claim 1 wherein said cross bracket through holes have a length of at least 2 inches.

15. The conversion kit of claim 1 wherein said cross bracket through holes have a length of at least 4 inches.

16. The conversion kit of claim 1 wherein said fabric sling vertical sides each have attachment mechanisms for attaching to the trekking pole tip segment.

17. The conversion kit of claim 1 wherein said compression bracket male end and female end each have a length of at least 1 inch.

* * * * *